US008226079B2

(12) United States Patent
Ozawa

(10) Patent No.: US 8,226,079 B2
(45) Date of Patent: Jul. 24, 2012

(54) MANUAL STAPLING MODE FOR SHEET FINISHING APPARATUS

(75) Inventor: Shogo Ozawa, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 69 days.

(21) Appl. No.: 12/848,770

(22) Filed: Aug. 2, 2010

(65) Prior Publication Data

US 2011/0031677 A1 Feb. 10, 2011

Related U.S. Application Data

(60) Provisional application No. 61/231,196, filed on Aug. 4, 2009.

(51) Int. Cl.
*B65H 37/04* (2006.01)

(52) U.S. Cl. ..... 270/58.09; 270/58.08; 399/410

(58) Field of Classification Search ..... 270/58.08, 270/58.09; 399/410

See application file for complete search history.

(56) References Cited

U.S. PATENT DOCUMENTS

| | | | | |
|---|---|---|---|---|
| 4,878,656 | A * | 11/1989 | Honjo et al. | 270/58.09 |
| 4,917,366 | A * | 4/1990 | Murakami et al. | 270/58.09 |
| 5,031,890 | A * | 7/1991 | Hosoi et al. | 270/58.09 |
| 5,060,922 | A * | 10/1991 | Shibusawa et al. | 270/58.09 |
| 5,139,249 | A * | 8/1992 | Hosoi et al. | 270/58.09 |
| 7,300,045 | B2 | 11/2007 | Terao et al. | |
| 7,648,136 | B2 | 1/2010 | Terao et al. | |
| 2007/0063411 | A1 | 3/2007 | Hirano | |

FOREIGN PATENT DOCUMENTS

JP 2002104720 A 4/2002

* cited by examiner

*Primary Examiner* — Patrick Mackey
(74) *Attorney, Agent, or Firm* — Patterson & Sheridan, LLP

(57) ABSTRACT

A stapling apparatus includes: a processing tray; a paper discharge unit configured to discharge sheets on the processing tray; an aligning unit configured to align sheets manually inserted onto the processing tray from a paper discharge port of the paper discharge unit; and a stapler configured to staple the sheets manually inserted on the processing tray.

17 Claims, 11 Drawing Sheets

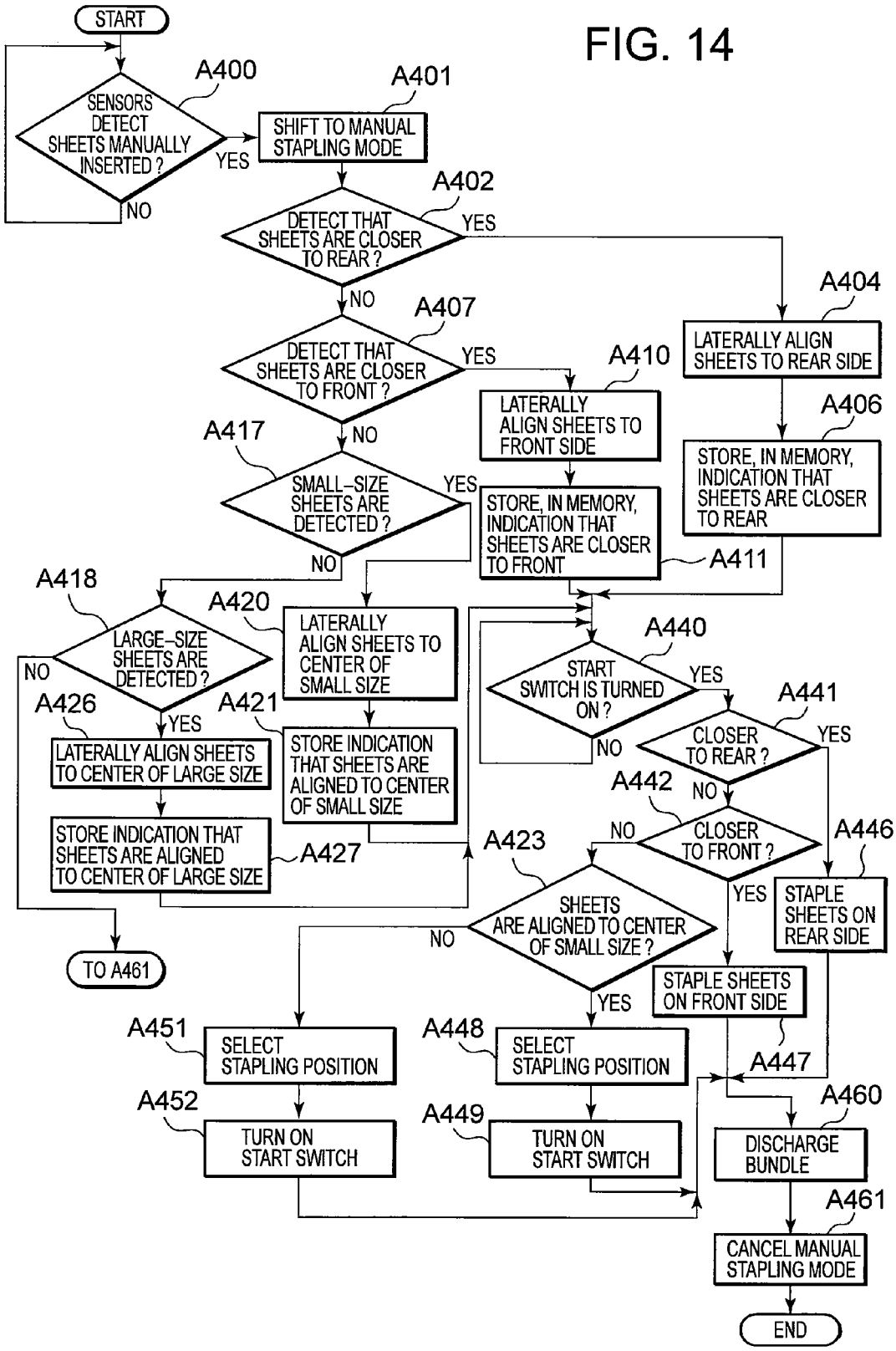
FIG. 14
START
A400
SENSORS DETECT SHEETS MANUALLY INSERTED ?
YES
NO
A401
SHIFT TO MANUAL STAPLING MODE
A402
DETECT THAT SHEETS ARE CLOSER TO REAR ?
YES
NO
A404
LATERALLY ALIGN SHEETS TO REAR SIDE
A406
STORE, IN MEMORY, INDICATION THAT SHEETS ARE CLOSER TO REAR
A407
DETECT THAT SHEETS ARE CLOSER TO FRONT ?
YES
NO
A410
LATERALLY ALIGN SHEETS TO FRONT SIDE
A411
STORE, IN MEMORY, INDICATION THAT SHEETS ARE CLOSER TO FRONT
A417
SMALL-SIZE SHEETS ARE DETECTED ?
YES
NO
A418
LARGE-SIZE SHEETS ARE DETECTED ?
NO
YES
A420
LATERALLY ALIGN SHEETS TO CENTER OF SMALL SIZE
A421
STORE INDICATION THAT SHEETS ARE ALIGNED TO CENTER OF SMALL SIZE
A426
LATERALLY ALIGN SHEETS TO CENTER OF LARGE SIZE
A427
STORE INDICATION THAT SHEETS ARE ALIGNED TO CENTER OF LARGE SIZE
TO A461
A440
START SWITCH IS TURNED ON ?
YES
NO
A441
CLOSER TO REAR ?
YES
NO
A442
CLOSER TO FRONT ?
NO
YES
A446
STAPLE SHEETS ON REAR SIDE
A423
SHEETS ARE ALIGNED TO CENTER OF SMALL SIZE ?
NO
YES
STAPLE SHEETS ON FRONT SIDE
A451
SELECT STAPLING POSITION
A452
TURN ON START SWITCH
A448
SELECT STAPLING POSITION
A449
TURN ON START SWITCH
A447
A460
DISCHARGE BUNDLE
A461
CANCEL MANUAL STAPLING MODE
END

MANUAL STAPLING MODE FOR SHEET FINISHING APPARATUS

CROSS-REFERENCE TO RELATED APPLICATION

This application is based upon and claims the benefit of priority from provisional U.S. Application 61/231,196 filed on Aug. 4, 2009, the entire contents of which are incorporated herein by reference.

FIELD

Embodiments described herein relate generally to a sheet finishing apparatus configured to perform finishing of sheets supplied from an image forming apparatus such as a copying machine, a printer, and a multi functional peripheral.

BACKGROUND

There is a sheet finishing apparatus configured to apply finishing such as sorting and stapling to sheets supplied from an image forming apparatus and staple, with manual operation, a sheet bundle inserted from the outside by an operator.

In the sheet finishing apparatus having a manual stapling function in this way, since the operator manually inserts a sheet bundle into the sheet finishing apparatus, it is likely that deviation occurs in an inserting position of the sheet bundle inserted into the sheet finishing apparatus and a stapling position deviates.

Therefore, there is a demand for a sheet finishing apparatus configured to prevent a sheet position from deviating in the sheet finishing apparatus even when sheets are manually inserted.

BRIEF DESCRIPTION OF THE DRAWINGS

FIG. 14 is a flowchart for explaining a manual stapling mode according to the second embodiment.

DETAILED DESCRIPTION

According to an embodiment, a stapling apparatus includes: a processing tray; a paper discharge unit configured to discharge sheets on the processing tray; an aligning unit configured to align sheets manually inserted onto the processing tray from a paper discharge port of the paper discharge unit; and a stapler configured to staple the sheets manually inserted on the processing tray.

Embodiments are explained below.

(First Embodiment)

Figure 1:
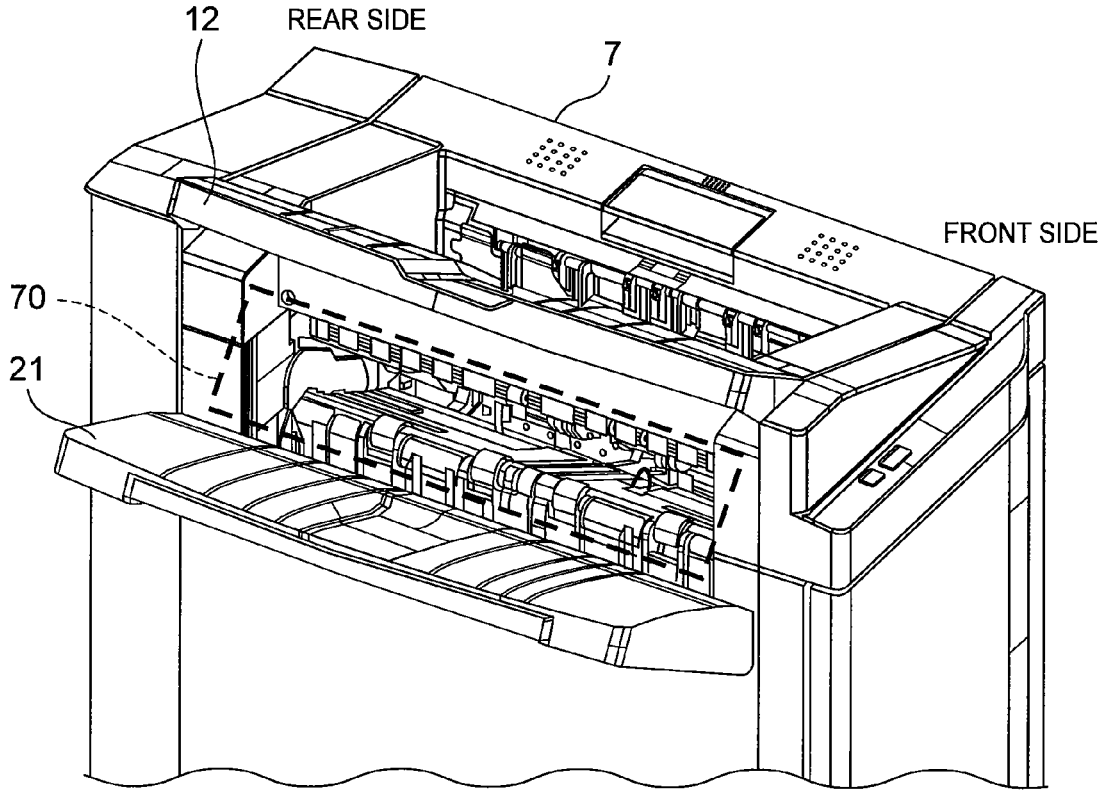
FIG. 1 is a schematic perspective view of a finisher according to a first embodiment viewed from a paper discharge side.
Figure 2:
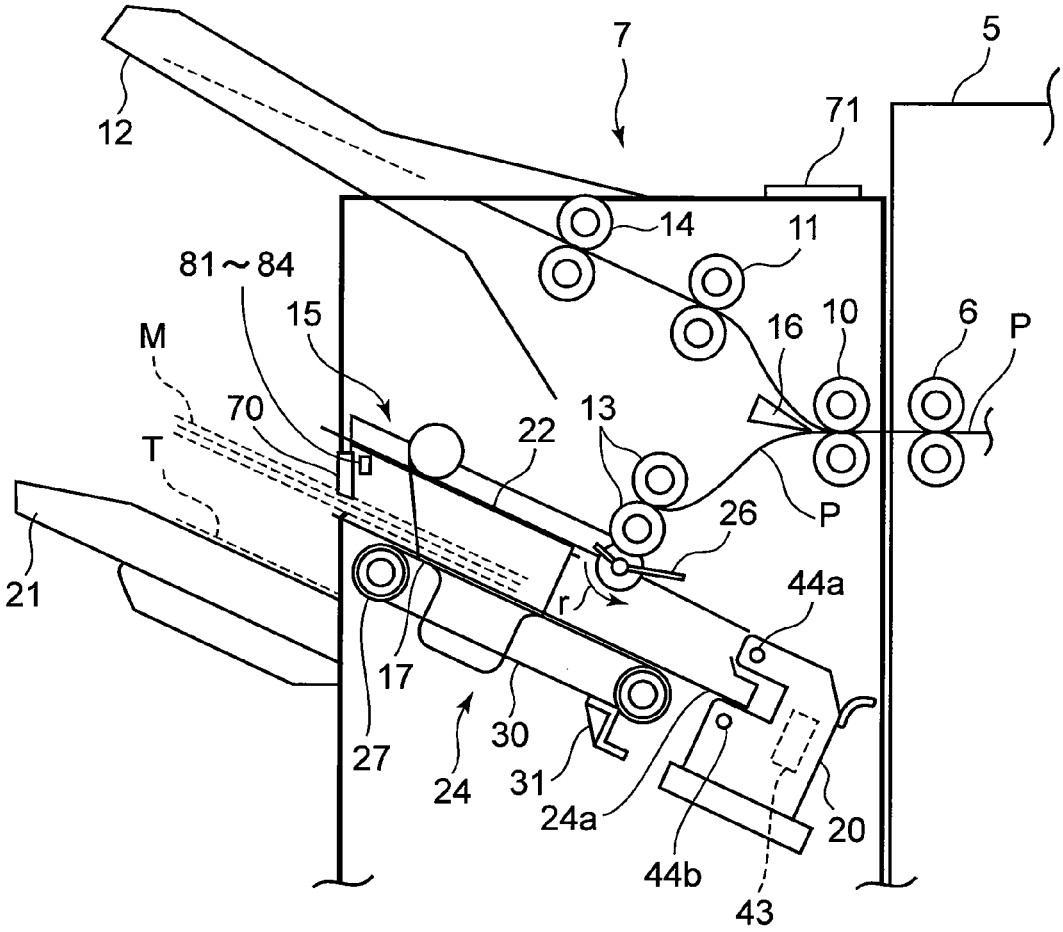
FIG. 2 is a schematic diagram of the finisher according to the first embodiment.

As shown in FIGS. 1 and 2, a finisher 7 discharges, onto a fixed tray 12 or a paper discharge tray 21, a sheet P subjected to image formation by an image forming unit of, for example, a MFP (Multi Functional Peripheral) 5 and supplied from a pair of supply rollers 6. The finisher 7 includes an inlet roller pair 10 configured to receive the sheet P subjected to the image formation by the MFP 5 and supplied from the supply rollers 6. The finisher 7 includes a gate 16 downstream of the inlet roller pair 10. The gate 16 directs the sheet P in the direction of a first conveying roller pair 11 or the direction of a second conveying roller pair 13.

The finisher 7 includes a paper discharge roller pair 14 configured to discharge, onto the fixed tray 12, the sheet P conveyed by the first conveying roller pair 11. The finisher 7 includes a processing mechanism 15 configured to discharge, onto the paper discharge tray 21, a sheet conveyed by the second conveying roller pair 13.

The processing mechanism 15 includes a waiting tray 22, a processing tray 17, lateral alignment plates 18, paddles 26, and a stapler 20. The processing mechanism 15 includes a conveying mechanism 24 that is a paper discharge unit configured to discharges sheets on the processing tray 17.

Figure 3:
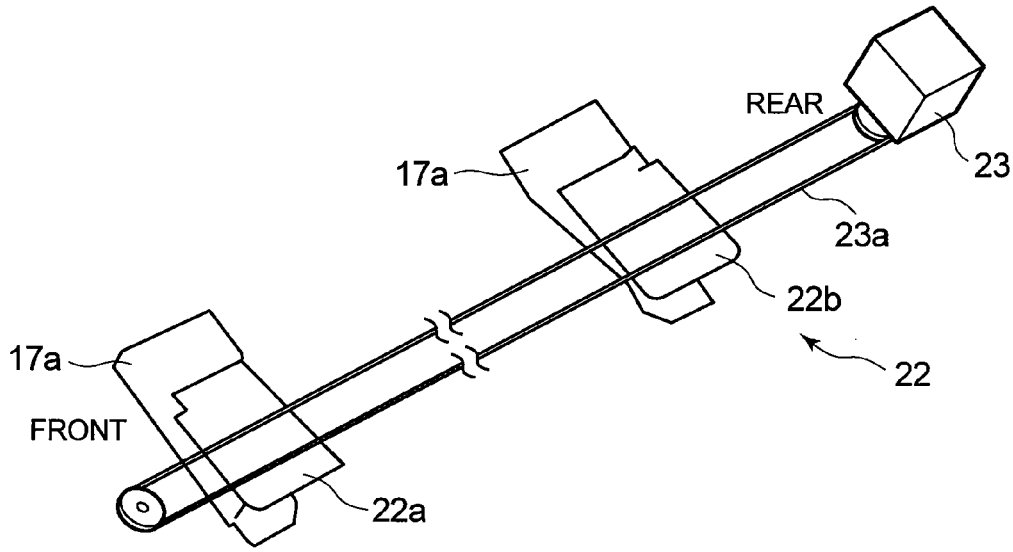
FIG. 3 is a schematic explanatory diagram of a waiting tray according to the first embodiment.

The waiting tray 22 temporarily waits the sheet P supplied from the second conveying roller pair 13 until finishing for the sheets on the processing tray 17 finishes. As shown in FIG. 3, the waiting tray 22 includes a front side buffer tray 22*a* and a rear side buffer tray 22*b*. When no preceding sheet is left on the processing tray 17, the front side buffer tray 22*a* is shifted to the front side and the rear side buffer tray 22*b* is shifted to the rear side. The sheet P on the waiting tray 22 falls to the processing tray 17. The front side buffer tray 22*a* and the rear side buffer tray 22*b* are slid by a buffer tray guide motor 23 via a timing belt 23*a*.

Figure 4:
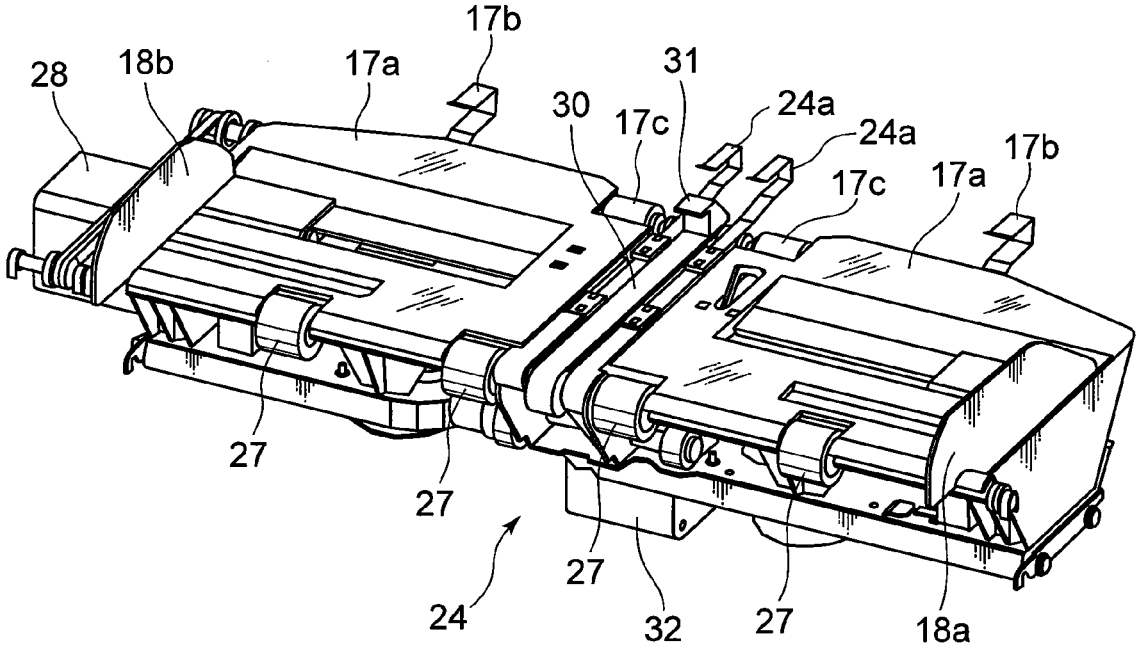
FIG. 4 is a schematic perspective view of a processing tray and a conveying mechanism according to the first embodiment.

As shown in FIG. 4, the processing tray 17 has sheet supporting surfaces 17*a* on which sheets P dropped from the waiting tray 22 are placed and accumulated. The sheet supporting surfaces 17*a* are inclined to be higher on the paper discharge tray 21 side in a conveying direction of the sheets P. Rear end stoppers 17*b* and longitudinal alignment rollers 17*c* are provided on the rear end side of the sheet, supporting surfaces 17*a* in the conveying direction of the sheets P. Outlet rollers 27 are provided on the front end sides of the sheet supporting surfaces 17*a* in the conveying direction of the sheets P. A sheet bundle T stacked on the sheet supporting surfaces 17*a* is sequentially longitudinally aligned by the longitudinal alignment rollers 17*c*, the outlet rollers 27, and the paddles 26 with a trailing end thereof in the conveying direction regulated by the rear end stopper 17*b*.

Figure 5:
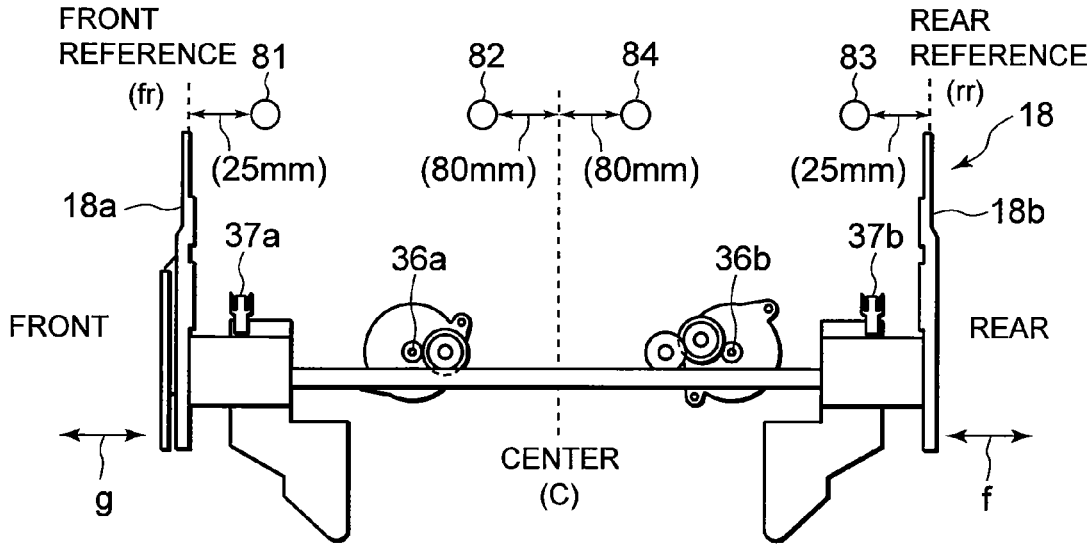
FIG. 5 is a schematic explanatory diagram of lateral alignment plates and sensors according to the first embodiment.

The lateral alignment plates 18 align the sheets P on the processing tray 17 to the front side or the rear side. The lateral alignment plates 18 include a front side alignment plate 18*a* that stops at a front reference fr and a rear side alignment plate 18*b* that stops at a rear reference rr. The lateral alignment plates 18 prevent the sheets P from being disarranged in the front side or rear side direction orthogonal to a supply direction of the sheets P. As shown in FIG. 5, the front side alignment plate 18*a* is reciprocatingly moved by a front alignment motor 36*a*. The rear side alignment plate 18*b* is reciprocatingly moved by a rear alignment motor 36*b*. The lateral alignment plates 18 include a front home position sensor 37*a* for detecting a home position of the front side alignment plate 18*a* and a rear home position sensor 37*b* for detecting a home position of the rear side alignment plate 18*b*.

The stapler 20 is located at the rear ends of the sheet supporting surfaces 17*a* in the conveying direction of the sheet bundle T. The stapler 20 staples one place at a front side corner, staples one place at a rear side corner, or staples two places in the center. An opening for nipping the sheet bundle T of the stapler 20 includes a light emitting element 44*a* and a light receiving element 44*b* and detects that the sheet bundle T is inserted into the stapler 20. The stapler 20 incorporates a stapler motor 43 for performing stapling operation.

Figure 6:
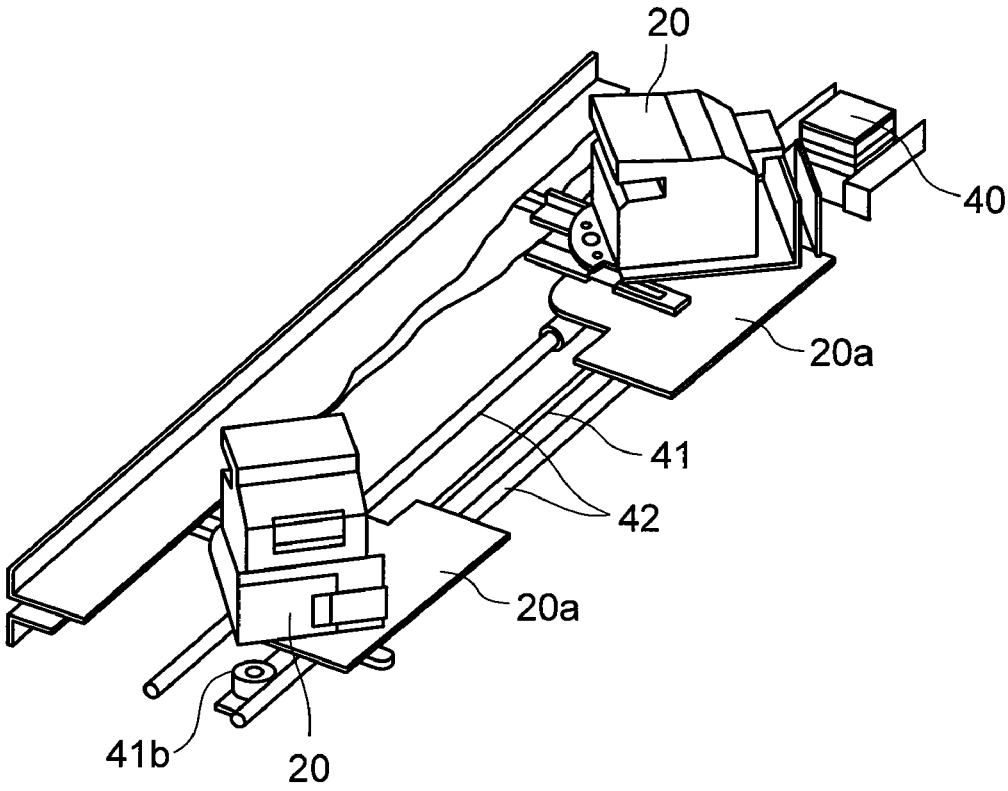
FIG. 6 is a schematic perspective view of a stapler according to the first embodiment.
Figure 7:
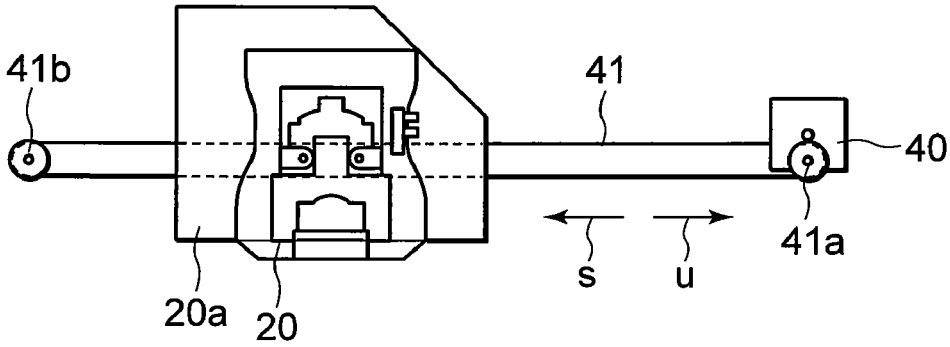
FIG. 7 is a schematic explanatory diagram of a driving system of the stapler according to the first embodiment.

As shown in FIGS. 6 and 7, a stapler unit 20*a* supports the stapler 20. A stapler shift motor 40 drives the stapler unit 20*a* via a timing belt 41 laid over a driving pulley 41*a* and a driven pulley 41*b*. The stapler unit 20*a* reciprocatingly moves along a rail 42.

The conveying mechanism 24 includes a pair of ejectors 24*a* projecting from the rear end faces of the sheet supporting surfaces 17*a*, a conveyor belt 30 provided between the pair of ejectors 24*a*, and the outlet rollers 27. The ejectors 24*a* push out the sheet bundle T present on the sheet supporting surfaces 17*a*. The conveyor belt 30 includes a bundle pawl 31. When sorting or stapling of the sheet bundle T on the sheet supporting surfaces 17*a* is finished, the ejectors 24*a* and the outlet rollers 27 start discharge of the sheet bundle T in the direction of the paper discharge tray 21. Thereafter, the bundle pawl 31 of the conveyor belt 30 overtakes the ejectors 24*a*. The bundle pawl 31 and the outlet rollers 27 discharge the sheet bundle T from a paper discharge port 70 onto the paper discharge tray 21. When the bundle pawl 31 discharges the sheet bundle T, the ejectors 24*a* return in the rear end direction of the sheet supporting surfaces 17*a* with force of springs.

In performing stapling with manual operation in the finisher 7, an operator inserts bundle-like sheets manually inserted M from the paper discharge port 70 onto the processing tray 17. As shown in FIG. 5, the paper discharge port 70 includes reflective sensors 81 to 84 configured to detect the sheets manually inserted M. For example, a first front sensor 81 detects the sheets manually inserted M in a position 25 mm to the center C side of the processing tray 17 from the front reference fr. A second front sensor 82 detects the sheets manually inserted M in a position 80 mm to the front side from the center C. For example, a first rear sensor 83 detects the sheets manually inserted M in a position 25 mm to the center C side of the processing tray 17 from the rear reference rr. A second rear sensor 84 detects the sheets manually inserted M in a position 80 mm to the rear side from the center C.

Figure 8:
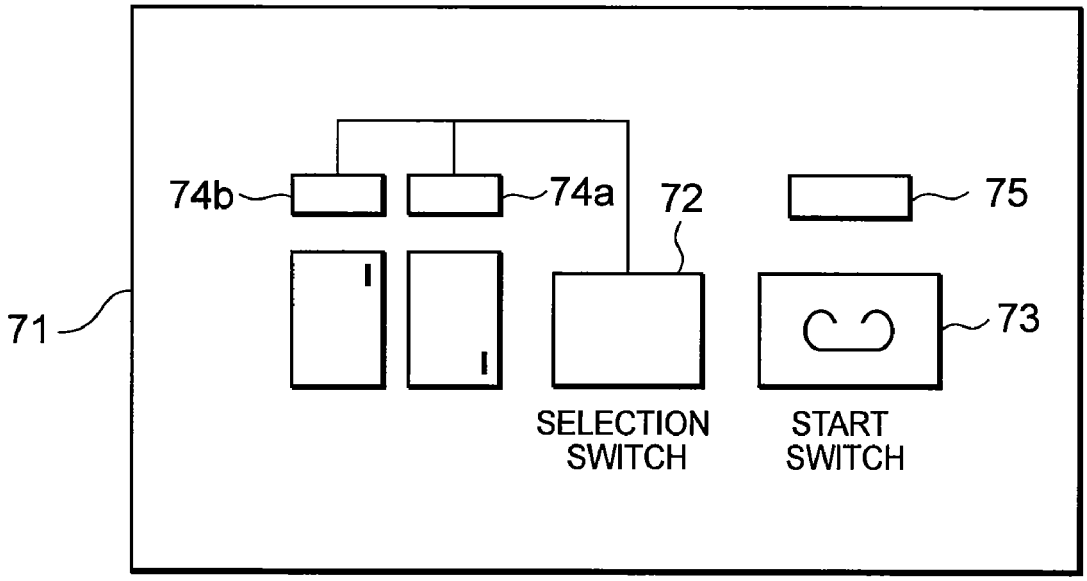
FIG. 8 is an explanatory diagram of a panel of the stapler according to the first embodiment.

The finisher 7 includes a panel 71 for manual operation on the upper surface thereof. As shown in FIG. 8, the panel 71 includes a manual indicating section 75 of, for example, LED configured to indicate the manual operation, a selection switch 72 for staple position selection, and a start switch 73. The panel 71 includes a front selection indicating section 74*a* and a rear selection indicating section 74*b* of, for example, LED configured to respond to the operation of the selection switch 72. When pressed once, the selection switch 72 selects stapling on the front side and lights the front selection indicating section 74*a*. When pressed once more, the selection switch 72 selects stapling on the rear side and lights the rear selection indicating section 74*b*. In response to the selection, the finisher 7 slides the stapler 20 in an arrow s direction or an arrow u direction in FIG. 7.

Figure 9:
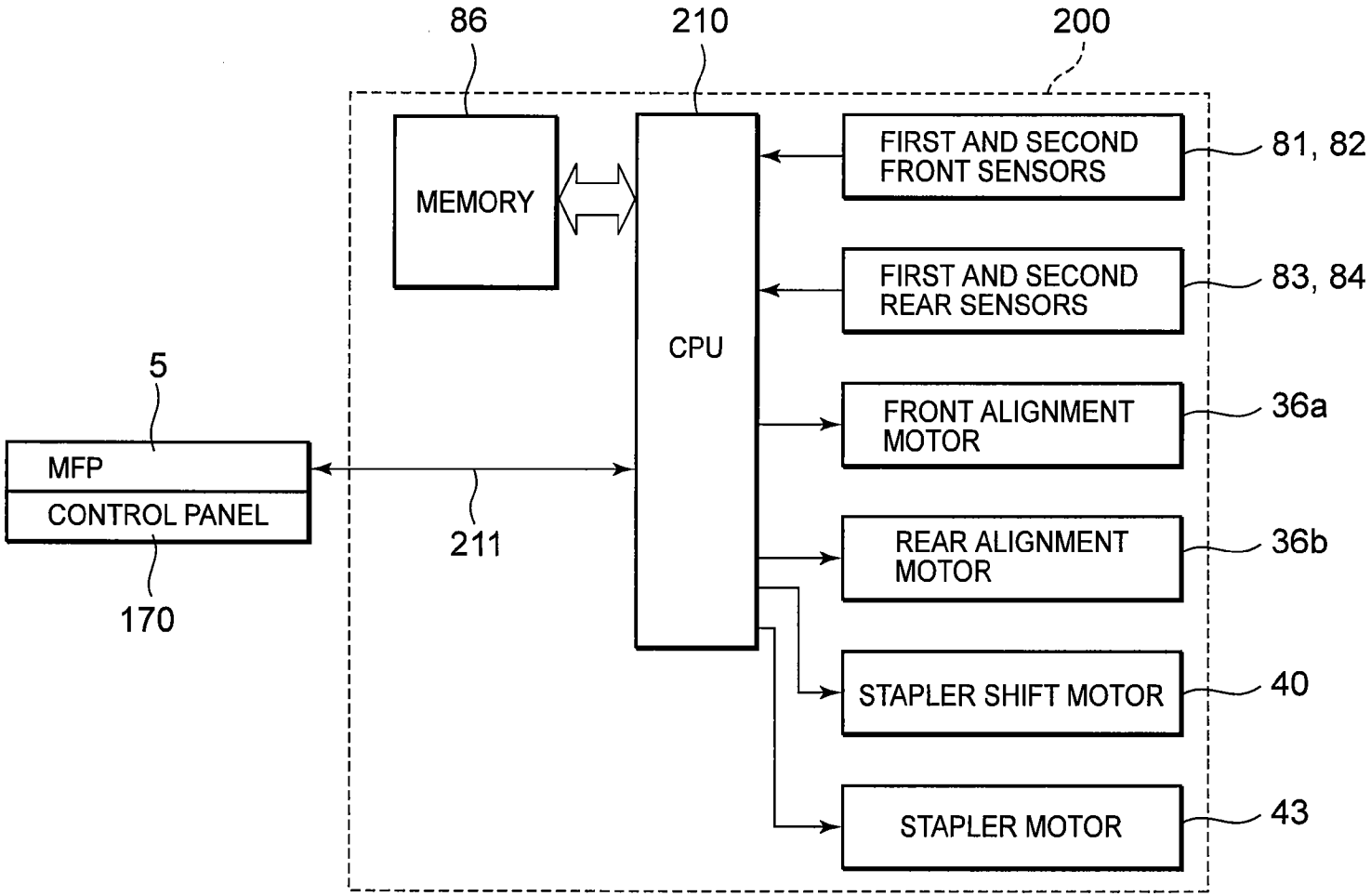
FIG. 9 is a schematic block diagram of a control system configured to mainly control manual operation of the finisher according to the first embodiment.

A control system 200 configured to mainly control manual operation of the finisher 7 is shown in FIG. 9. A CPU 210 of the control system 200 communicates with the MFP 5 via an interface 211. The MFP 5 inputs a setting condition for the finisher 7 or displays a state of the finisher 7 on a control panel 170. The CPU 210 is connected to the first and second front sensors 81 and 82 and the first and second rear sensors 83 and 84. The CPU 210 is connected to the front alignment motor 36*a*, the rear alignment motor 36*b*, the stapler shift motor 40, and the stapler motor 43. The CPU 210 includes a memory 86 configured to store indication of whether an alignment reference for the sheets manually inserted M is a front reference or a rear reference.

Actions are explained below.

(When Finishing is not Performed)

When neither sorting nor stapling of the sheet P supplied from the MFP 5 is performed, the finisher 7 directs, in the gate 16, the sheet P in the direction of the first conveying roller pair 11 and discharges the sheet P onto the fixed tray 12 with the paper discharge roller pair 14.

(During Finishing in an Auto Mode)

When the sheet P supplied from the MFP 5 is subjected to finishing, the finisher 7 directs, with the gate 16, the sheet P in the direction of the second conveying roller pair 13 and supplies the sheet P to a directing processing mechanism 15. When there is no preceding sheet P on the processing tray 17, the finisher 7 directly supplies the sheet P from the second conveying roller pair 13 to the sheet supporting surfaces 17*a*. When a preceding sheet is being subjected to finishing on the processing tray 17, the finisher 7 supplies the sheet P from the second conveying roller pair 13 to the waiting tray 22. When the conveying mechanism 24 discharges the preceding sheet from the processing tray 17, the finisher 7 drops and supplies the sheet P on the waiting tray 22 to the sheet supporting surfaces 17*a*.

The lateral alignment plates 18 laterally align the sheets Pan the sheet supporting surface 17*a*. For example, during stapling at the front reference fr, the front side alignment plate 18*a* is stopped at the front reference fr. As indicated by an arrow f in FIG. 5, the rear side alignment plate 18*b* is reciprocatingly moved in the width direction by the rear alignment motor 36*b* to laterally align the sheets P. The paddles 26 are rotated in an arrow r direction in FIG. 2 to longitudinally align the sheets P. The stapler shift motor 40 slides the stapler 20 in the arrow s direction or the arrow u direction in FIG. 7 according to a type of stapling. The stapler 20 staples the sheet bundle T laterally and longitudinally aligned on the sheet supporting surfaces 17*a*. After the stapling finishes, the conveying mechanism 24 discharges the sheet bundle T onto the paper discharge tray 21.

(During a Manual Stapling Mode)

Figure 10:
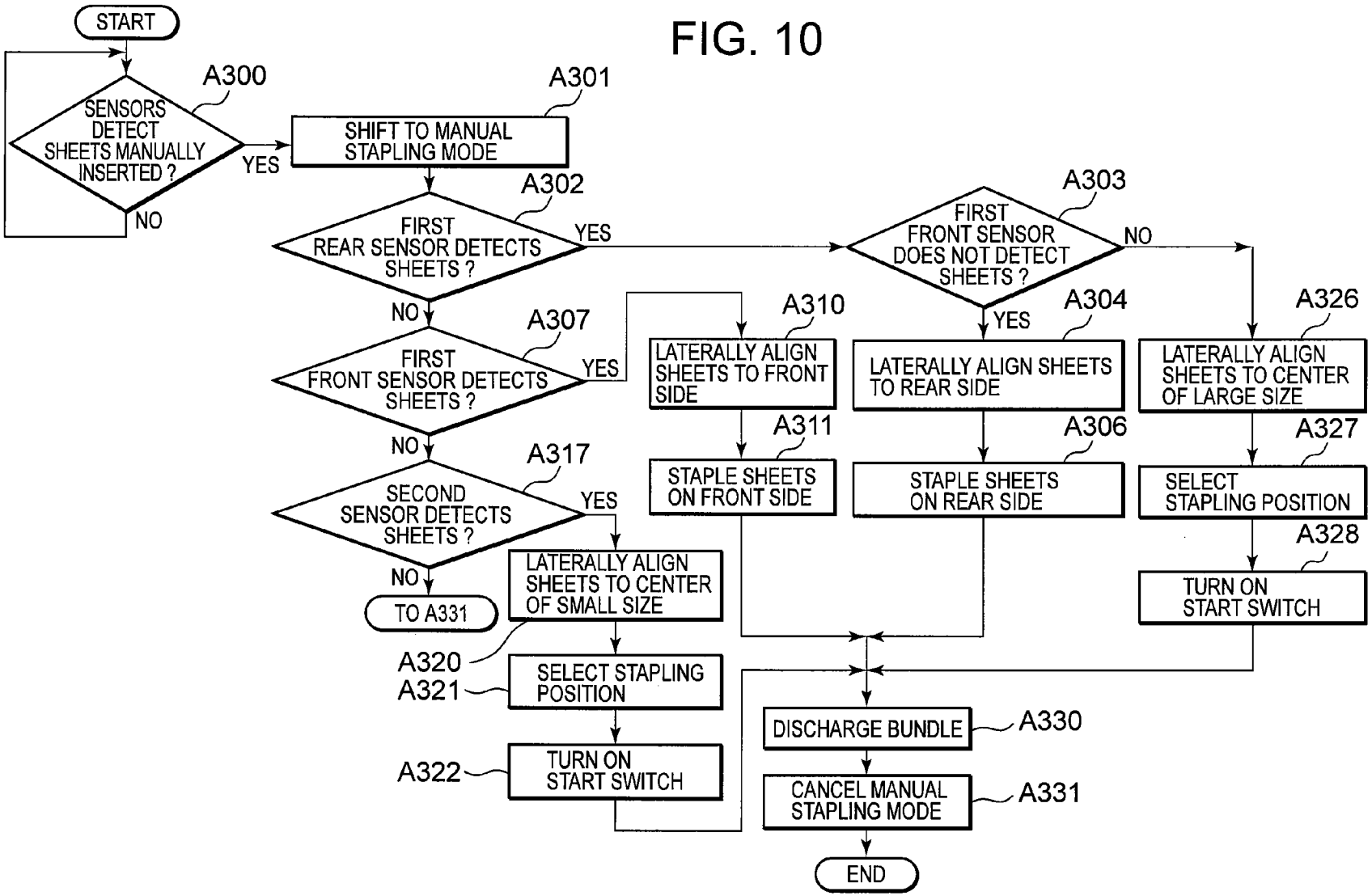
FIG. 10 is a flowchart for explaining a manual stapling mode according to the first embodiment.
Figure 11:
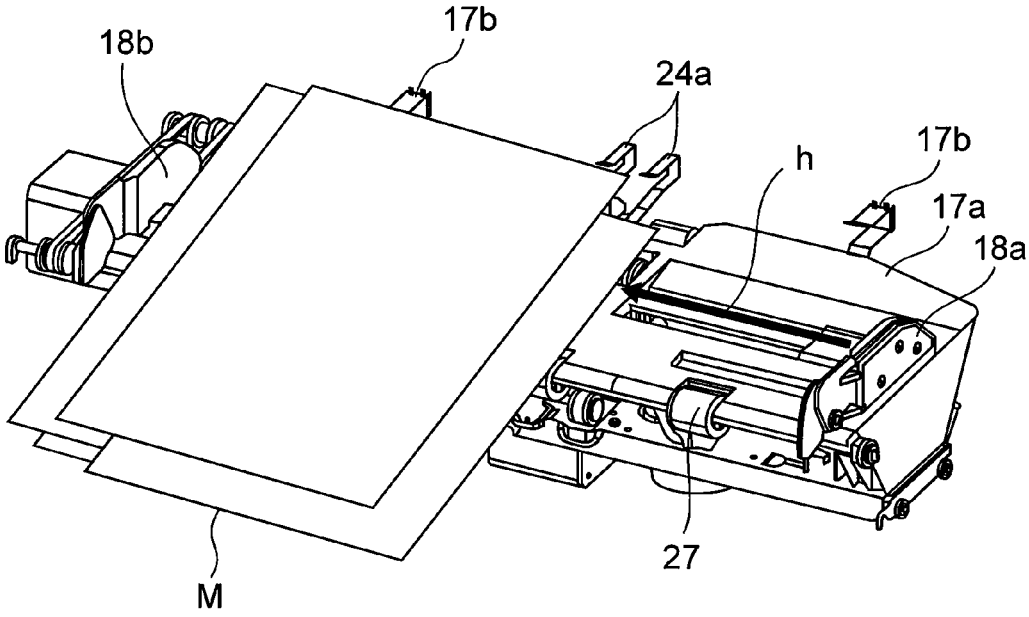
FIG. 11 is a schematic perspective view of sheets manually inserted which inserted closer to a rear side according to the first embodiment.

As shown in FIG. 10, after the auto mode finishes, in order to start manual operation, the operator directly inserts the bundle-like sheets manually inserted M of the A4 portrait size into the paper discharge port 70. When stapling the sheets manually inserted M on the rear side, the operator inserts the sheets manually inserted M closer to the rear side. When stapling the sheets manually inserted M on the front side, the operator inserts the sheets manually inserted M closer to the front side. When any one of the sensors 81 to 84 detects the sheets manually inserted M inserted into the paper discharge port 70 (Yes in A300), the finisher 7 shifts from the auto mode to the manual stapling mode (A301). When the sheets manually inserted. M are inserted closer to the rear side as shown in FIG. 11, the first rear sensor 83 detects the sheets manually inserted M (Yes in A302), and the first front sensor 81 does not detect the sheets manually inserted M (Yes in A303), the CPU 210 proceeds to A304. In A304, the CPU 210 stops the rear side alignment plate 18*b* at the rear reference rr. After sliding the front side alignment plate 18*a* in an arrow h direction in FIG. 11 with the front alignment motor 36*a*, as indicated by an arrow g in FIG. 5, the CPU 210 reciprocatingly moves the front side alignment plate 18*a* in the width direction to laterally align the bundle-like sheets manually inserted M to a precise stapling position on the rear side. The CPU 210 slides the stapler 20 in the arrow u direction in FIG. 7 and staples the sheets manually inserted M on the rear side (A306). After the stapling finishes, the conveying mechanism 24 discharges the sheets manually inserted M onto the paper discharge tray 21 (A330).

Figure 12:
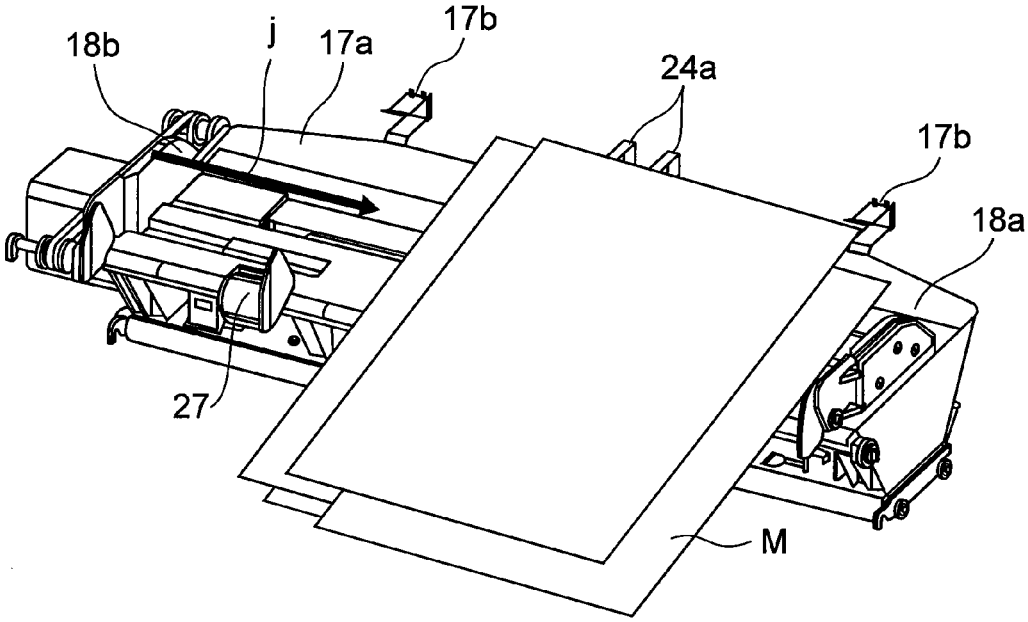
FIG. 12 is a schematic perspective view of sheets manually inserted which inserted closer to a front side according to the first embodiment.

When the first rear sensor 83 does not detect the sheets manually inserted M (No in A302), the CPU 210 proceeds to A307. When the sheets manually inserted M are inserted closer to the front side as shown in FIG. 12 and the first front sensor 81 detects the sheets manually inserted M (Yes in A307), the CPU 210 proceeds to A310. In A310, the CPU 210 stops the front side alignment plate 18*a* at the front reference fr. After sliding the rear side alignment plate 18*b* in an arrow j direction in FIG. 12 with the rear alignment motor 36*b*, as indicated by the arrow f in FIG. 5, the CPU 210 reciprocatingly moves the rear side alignment plate 18*b* in the width direction to laterally align the bundle-like sheets manually inserted M to a precise stapling position on the front side. The CPU 210 slides the stapler 20 in the arrow s direction in FIG. 7 and staples the sheets manually inserted M on the front side (A311). After the stapling finishes, the conveying mechanism 24 discharges the sheets manually inserted M onto the paper discharge tray 21 (A330).

When the first front sensor 81 does not detect the sheets manually inserted M (No in A307), the CPU 210 proceeds to A317 and determines whether the second front sensor 82 and the second rear sensor 84 detect the sheets manually inserted M. When the second front sensor 82 and the second rear sensor 84 do not detect the sheets manually inserted M (No in A317), the CPU 210 cancels the manual stapling mode (A331). The CPU 210 finishes the manual operation and shifts to the auto mode.

When the second front sensor 82 and the second rear sensor 84 detect the sheets manually inserted M (Yes in A317), the CPU 210 determines that the sheets manually inserted M are sheets of a small size and laterally aligns the sheets manually inserted M in the center of the small size (CPU 210 laterally aligns the sheets manually inserted M of the small size by fit center position of the sheets manually inserted M of the small size and the center C). After sliding the front side alignment plate 18*a* and the rear side alignment plate 18*b* in the width direction to small size positions, the CPU 210 reciprocatingly moves the front side alignment plate 18*a* in the arrow g direction and reciprocatingly moves the rear side alignment plate 18*b* in the arrow f direction to laterally align the bundle-like sheets manually inserted M of the small size to a precise stapling position for the center alignment (A320). The operator presses the selection switch 72 of the panel 71 and selects a stapling position. According to the selection by the operator, the stapler 20 slides in the arrow s direction or the arrow u direction in FIG. 7. The operator checks the stapling position on the front selection indicating section 74*a* or the rear selection indicating section 74*b* (A321). When the operator turns on the start switch 73, the CPU 210 staples the sheets manually inserted M (A322). After the stapling finishes, the conveying mechanism 24 discharges the sheets manually inserted M of the small size onto the paper discharge tray (A330).

When the first front sensor 81 detects the sheets manually inserted M (No in A303), the CPU 210 determines that the sheets manually inserted M are sheets of a large size and laterally aligns the sheets manually inserted M in the center of the large size (CPU 210 laterally aligns the sheets manually inserted M of the large size by fit center position of the sheets manually inserted M of the large size and the center C). For example, the CPU 210 stops the front side alignment plate 18*a* at the front reference fr, stops the rear side alignment plate 18*b* at the rear reference rr, and reciprocatingly moves the front side alignment plate 18*a* and the rear side alignment plate 18*b* to laterally align the bundle-like sheets manually inserted M of the large size to a precise stapling position for the center alignment (A326). The operator presses the selection switch 72 of the panel 71 to select a stapling position. According to the selection by the operator, the stapler 20 slides in the arrow s direction or the arrow u direction in FIG. 7. The operator checks the stapling position on the front selection indicating section 74*a* or the rear selection indicating section 74*b* (A327). When the operator turns on the start switch 73, the CPU 210 staples the sheets manually inserted M (A328). After the stapling finishes, the conveying mechanism 24 discharges the sheets manually inserted M of the large size onto the paper discharge tray 21 (A330).

When the sheets manually inserted M are discharged onto the paper discharge tray 21 (A330) and the sensors 81 to 84 confirm that the sheets manually inserted M are not inserted in the paper discharge port 70, the CPU 210 cancels the manual stapling mode (A331). The CPU 210 finishes the manual operation and shifts to the auto mode.

According to the first embodiment, the finisher 7 detects the sheets manually inserted M inserted into the paper discharge port 70 after the finish of the auto mode and shifts to the manual stapling mode. When any one of the sensors 81 to 84 detects the sheets manually inserted M, the finisher 7 automatically laterally aligns the bundle-like sheets manually inserted M to a precise stapling position. During the manual stapling mode, even if the operator does not align the sheets manually inserted M to the precise stapling position to insert the sheets manually inserted M, it is possible to prevent the stapling position from deviating. During the manual stapling mode, the operator can easily perform operation for inserting the sheets manually inserted M.

(Second Embodiment)

A second embodiment is different from the first embodiment in that, during the manual stapling mode, a line sensor detects sheets manually inserted and an operator always selects a stapling position of the stapler 20 to instruct stapling. Otherwise, the second embodiment is the same as the first embodiment. In the second embodiment, components same as the components explained in the first embodiment are denoted by the same reference numerals and signs and detailed explanation of the components is omitted.

Figure 13:
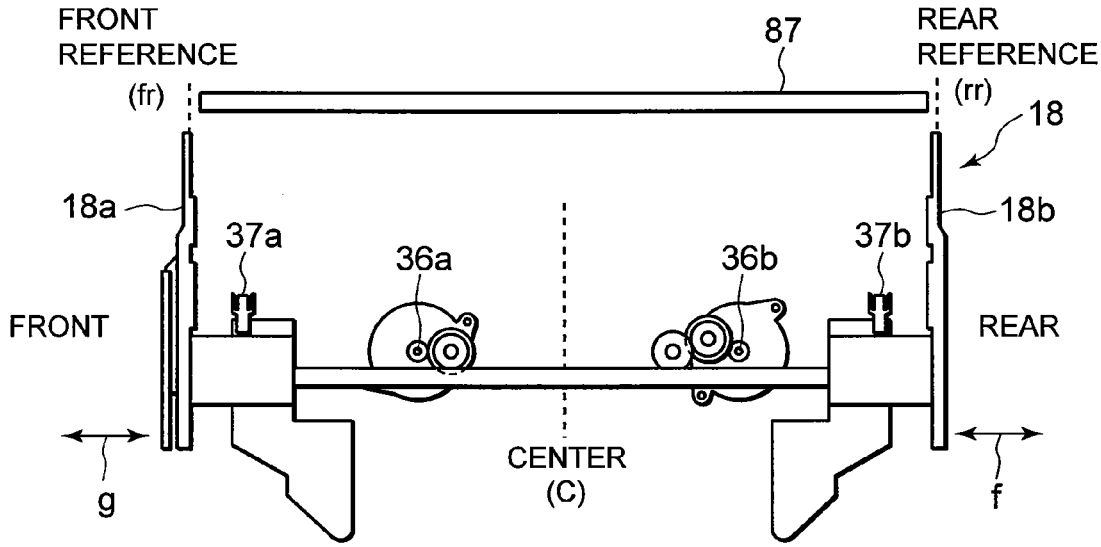
FIG. 13 is a schematic explanatory diagram of lateral alignment plates and a line sensor according to a second embodiment.

As shown in FIG. 13, the finisher 7 includes, in the paper discharge port 70, a line sensor 87 configured to detect the sheets manually inserted M.

(During the Manual Stapling Mode)

As shown in FIG. 14, after the auto mode finishes, according to the insertion of the bundle-like sheets manually inserted M into the paper discharge port 70 by the operator, when anyone of the sensors 81 to 84 detects the sheets manually inserted M (Yes in A400), the finisher 7 shifts from the auto mode to the manual stapling mode (A401). When the sheets manually inserted M are inserted closer to the rear side as shown in FIG. 11 and the line sensor 87 detects that the sheets manually inserted M are closer to the rear side (Yes in A402), the CPU 210 proceeds to A404. In A404, the CPU 210 stops the rear side alignment plate 18*b* at the rear reference rr. After sliding the front side alignment plate 18*a* in the arrow h direction in FIG. 11 with the front alignment motor 36*a*, the CPU 210 reciprocatingly moves the front side alignment plate 18*a* in the width direction as indicated by an arrow g in FIG. 13 to laterally align the bundle-like sheets manually inserted M to the precise stapling position on the rear side. The CPU 210 proceeds to A406, stores, in a memory 86, indication that the sheets manually inserted M are closer to the rear side, and proceeds to A440.

When the line sensor 87 does not detect that the sheets manually inserted M are closer to the rear side (No in A402), the CPU 210 proceeds to A407. When the sheets manually inserted M are inserted closer to the front side as shown in FIG. 12 and the line sensor 87 detects that the sheets manually inserted M are closer to the front side (Yes in A407), the CPU 210 proceeds to A410. In A410, the CPU 210 stops the front side alignment plate 18*a* at the front reference fr. After sliding the rear side alignment plate 18*b* in an arrow j direction in FIG. 12 with the rear alignment motor 36*b*, the CPU 210 reciprocatingly moves the rear side alignment plate 18*b* in the width direction as indicated by an arrow f in FIG. 13 to laterally align the bundle-like sheets manually inserted M to the precise stapling position on the front side. The CPU 210 proceeds to A411, stores, in the memory 86, indication that the sheets manually inserted M are closer to the front side, and proceeds to A440.

When the line sensor 87 does not detect that the sheets manually inserted M are closer to the front side (No in A407), the CPU 210 proceeds to A417 and determines whether the line sensor 87 detects the sheets manually inserted M of a small size. When the line sensor 87 detects the sheets manually inserted M of the small size (Yes in A417), the CPU 210 determines that the sheets manually inserted M are sheets of the small size and laterally aligns the sheets manually inserted M to the center of the small size. After sliding the front side alignment plate 18*a* and the rear side alignment plate 18*b* in the width direction to small size positions, the CPU 210 reciprocatingly moves the front side alignment plate 18*a* in the arrow g direction and reciprocatingly moves the rear side alignment plate 18*b* in the arrow f direction to laterally align the bundle-like sheets manually inserted M of the small size to a precise stapling position for the center alignment (A420). The CPU 210 proceeds to A421, stores, in the memory 86, indication that the sheets manually inserted M are aligned in the center of the small size, and proceeds to A440.

When the line sensor 87 does not detects the sheets manually inserted M of the small size (No in A417), the CPU 210 proceeds to A418 and determines whether the line sensor 87 detects the sheets manually inserted M of a large size. When the line sensor 87 detects the sheets manually inserted M of the large size (Yes in A418), the CPU 210 determines that the sheets manually inserted M are sheets manually inserted of the large size and laterally aligns the sheets manually inserted M to the center of the large size. For example, the CPU 210 stops the front side alignment plate 18*a* at the front reference fr, stops the rear side alignment plate 18*b* at the rear reference rr, and reciprocatingly moves the front side alignment plate 18*a* and the rear side alignment plate 18*b* to laterally align the bundle-like sheets manually inserted M of the large size to a precise stapling position for the center alignment (A426). The CPU 210 proceeds to A427, stores, in the memory 86, indication that the sheets manually inserted M is aligned to the center of the large size, and proceeds to A440.

When the line sensor 87 does not detect the sheets manually inserted M of the large size (No in A418), the CPU 210 cancels the manual stapling mode (A461). The CPU 210 finishes the manual operation and shifts to the auto mode.

When the operator turns on the start switch 73 in A440, the CPU 210 checks storage content of the memory 86. When the sheets manually inserted M are closer to the rear side (Yes in A441), the CPU 210 slides the stapler 20 in the arrow u direction in FIG. 7 and staples the sheets manually inserted M on the rear side (A446). After the stapling finishes, the conveying mechanism 24 discharges the sheets manually inserted M onto the paper discharge tray 21 (A460).

When the sheets manually inserted M are closer to the front side (Yes in A442), the CPU 210 slides the stapler 20 in the arrows direction in FIG. 7 and staples the sheets manually inserted M on the front side (A447). After the stapling finishes, the conveying mechanism 24 discharges the sheets manually inserted M onto the paper discharge tray 21 (A460).

When the sheets manually inserted M are aligned to the center of the small size (Yes in A423), the operator presses the selection switch 72 of the panel 71 and selects a stapling position for the small size. According to the selection by the operator, the stapler 20 slides in the arrow s direction or the arrow u direction in FIG. 7. The operator checks the stapling position on the front selection indicating section 74*a* or the rear selection indicating section 74*b* (A448). When the operator turns on the start switch 73, the CPU 210 staples the sheets manually inserted M of the small size (A449). After the stapling ends, the conveying mechanism 24 discharges the sheets manually inserted M of the small size onto the paper discharge tray 21 (A460).

When the sheets manually inserted M are aligned to the center of the large size (No in A423), the operator presses the selection switch 72 of the panel 71 and selects a stapling position for the large size. According to the selection by the operator, the stapler 20 slides in the arrow s direction or the arrow u direction in FIG. 7. The operator checks the stapling position on the front selection indicating section 74*a* or the rear selection indicating section 74*b* (A451). When the operator turns on the start switch 73, the CPU 210 staples the sheets manually inserted M of the large size (A452). After the stapling finishes, the conveying mechanism 24 discharges the sheets manually inserted M of the large size onto the paper discharge tray 21 (A460).

When the line sensor 87 confirms that the sheets manually inserted M are not inserted in the paper discharge port 70, the CPU 210 cancels the manual stapling mode (A461). The CPU 210 finishes the manual operation and shifts to the auto mode.

According to the second embodiment, as in the first embodiment, the finisher 7 detects the sheets manually inserted M inserted in the paper discharge port 70 after the finish of the auto mode and shifts to the manual stapling mode. When the finisher 7 detects the sheets manually inserted M with the line sensor 87, the finisher 7 automatically laterally aligns the bundle-like sheets manually inserted M to a precise stapling position. During the manual stapling mode, even if the operator does not align the sheets manually inserted M to the precise stapling position to insert the sheets manually inserted M, it is possible to prevent the stapling position from deviating. During the manual stapling mode, the operator can easily perform operation for inserting the sheets manually inserted M.

While certain embodiments have been described these embodiments have been presented by way of example only, and are not intended to limit the scope of the inventions. Indeed, the novel apparatus and methods described herein may be embodied in a variety of other forms: furthermore various omissions, substitutions and changes in the form of the apparatus and methods described herein may be made without departing from the spirit of the inventions. The accompanying claims and there equivalents are intended to cover such forms of modifications as would fall within the scope and spirit of the invention.

What is claimed is:

1. A stapling apparatus comprising:

a processing tray;

a paper discharge unit configured to discharge sheets on the processing tray;

an aligning unit configured to align sheets manually inserted onto the processing tray from a paper discharge port of the paper discharge unit;

a sensor that includes a front sensor closer to a front reference side of the processing tray and a rear sensor closer to a rear reference side of the processing tray and configured to detect whether the manually inserted sheets on the processing tray are closer to a front side or closer to a rear side of the processing tray; and a stapler configured to staple the manually inserted sheets.

2. The apparatus according to claim 1, wherein, when the rear sensor does not detect the manually inserted sheets, the aligning unit shifts the manually inserted sheets to the front reference side and, when the front sensor does not detect the manually inserted sheets, the aligning unit shifts the manually inserted sheets to the rear reference side.

3. The apparatus according to claim 2, wherein the stapler moves in a direction orthogonal to an inserting direction of the manually inserted sheets, moves to the front side of the processing tray to staple the manually inserted sheets when the manually inserted sheets are shifted to the front reference side, and moves to the rear side of the processing tray to staple the manually inserted sheets when the manually inserted sheets are slid to the rear reference side.

4. The apparatus according to claim 2, wherein the stapler staples sheets supplied from an image forming unit to the processing tray during an auto mode and staples the manually inserted sheets during a manual mode.

5. The apparatus according to claim 2, further comprising a control unit configured to set a driving mode of the stapler, wherein the control unit sets the driving mode of the stapler to a manual mode when the sensor detects the insertion of the manually inserted sheets.

6. The apparatus according to claim 2, further comprising a control unit configured to align the manually inserted sheets in a center reference if the rear sensor and the front sensor detect the manually inserted sheets at a same time.

7. The apparatus according to claim 6, wherein the rear sensor comprises a first rear sensor and a second rear sensor that is closer to a center than the first rear sensor, the front sensor comprises a first front sensor and a second front sensor that is closer to the center than the first front sensor, the controller determines that the manually inserted sheets are sheets of a large size and aligns the manually inserted sheets at the center reference of the large size if the first rear sensor and the first front sensor detect the manually inserted sheets, and the controller determines that the manually inserted sheets are sheets of a small size and aligns the manually inserted sheets at the center reference of the small size if the first rear sensor and the first front sensor do not detect the manually inserted sheets and the second rear sensor and the second front sensor detect the manually inserted sheets.

8. A sheet finishing apparatus comprising:

a processing tray on which sheets supplied from an image forming unit are placed;

a paper discharge unit configured to discharge the sheets on the processing tray;

a sensor that includes a front sensor closer to a front reference side of the processing tray and a rear sensor closer to a rear reference side of the processing tray, wherein the sensor detects whether the manually inserted sheets on the processing tray are closer to a front side or closer to a rear side of the processing tray;

an aligning unit configured to shift the manually inserted sheets to the front reference side in a direction orthogonal to an inserting direction if the rear sensor does not detect the manually inserted sheets, shift the manually inserted sheets to the rear reference side in a direction orthogonal to an inserting direction if the front sensor does not detect the manually inserted sheets, and align the manually inserted sheets onto the processing tray from a paper discharge port of the paper discharge unit; and a stapler configured to staple the sheets or the manually inserted sheets on the processing tray.

9. The apparatus according to claim 8, wherein the stapler moves in the direction orthogonal to the inserting direction of the manually inserted sheets, when the manually inserted sheets are shifted to the front reference side, moves to the front side of the processing tray to staple the manually inserted sheets, and, when the manually inserted sheets are slid to the rear reference side, moves to the rear side of the processing tray to staple the manually inserted sheets.

10. The apparatus according to claim 8, wherein the stapler staples sheets supplied from the image forming unit to the processing tray during an auto mode and staples sheets manually inserted onto the processing tray from the paper discharge port during a manual mode.

11. The apparatus according to claim 10, further comprising a control unit configured to set a driving mode of the stapler, wherein the control unit sets the driving mode of the stapler to a manual mode when the sensor detects the insertion of the manually inserted sheets.

12. The apparatus according to claim 8, further comprising a control unit configured to align the manually inserted sheets in a center reference if the rear sensor and the front sensor detect the manually inserted sheets at a same time.

13. The apparatus according to claim 12, wherein the rear sensor comprises a first rear sensor and a second rear sensor which is closer to a center than the first rear sensor, the front sensor comprises a first front sensor and a second front sensor which is closer to the center than the first front sensor, the controller determines that the manually inserted sheets are sheets of a large size and aligns the manually inserted sheets at the center reference of the large size if the first rear sensor and the first front sensor detect the manually inserted sheets, and the controller determines that the manually inserted sheets are sheets of a small size and aligns the manually inserted sheets at the center reference of the small size if the first rear sensor and the first front sensor do not detect the manually inserted sheets and the second rear sensor and the second front sensor detect the manually inserted sheets.

14. The apparatus according to claim 13, wherein the aligning unit aligns the manually inserted sheets at the center reference if the rear sensor and the front sensor detect the manually inserted sheets.

15. The apparatus according to claim 14, wherein the rear sensor comprises a first rear sensor and a second rear sensor which is closer to a center than the first rear sensor, the front sensor comprises a first front sensor and a second front sensor which is closer to the center than the first front sensor, the aligning unit aligns the manually inserted sheets at the center reference of the large size if the first rear sensor and the first front sensor detect the manually inserted sheets, and the aligning unit aligns the manually inserted sheets at the center reference of the small size if the first rear sensor and the first front sensor do not detect the manually inserted sheets and the second rear sensor and the second front sensor detect the manually inserted sheets.

16. A stapling method comprising:

inserting sheets manually onto a processing tray through a paper discharge port;

detecting whether the manually inserted sheets are closer to a front side or a rear side of the processing tray;

aligning the manually inserted sheets to a front reference side if the manually inserted sheets are closer to the front side of the processing tray and aligning the manually inserted sheets to a rear reference side if the manually inserted sheets are closer to the rear side of the processing tray; and stapling the manually inserted sheets on the processing tray.

17. The method according to claim 16, further comprising stapling the manually inserted sheets on the front side when the manually inserted sheets are aligned to the front reference side and stapling the manually inserted sheets on the rear side when the manually inserted sheets are aligned to the rear reference side.

* * * * *